US005375404A

United States Patent [19]

Conway

[11] Patent Number: 5,375,404

[45] Date of Patent: Dec. 27, 1994

[54] WIDE ROPE WITH REDUCED INTERNAL CONTACT STRESSES

[75] Inventor: Ted A. Conway, Cuyahoga Falls, Ohio

[73] Assignee: The University of Akron, Akron, Ohio

[21] Appl. No.: 29,128

[22] Filed: Mar. 10, 1993

[51] Int. Cl.[5] ..... D02G 3/36; D07B 1/06

[52] U.S. Cl. ..... 57/212; 57/9; 57/218; 57/219; 57/311; 57/902; 140/149

[58] Field of Search ..... 57/212, 213, 214, 218, 57/219, 311, 902, 9, 138; 29/428; 140/149

[56] References Cited

U.S. PATENT DOCUMENTS

| | | | |
|---|---|---|---|
| 251,114 | 12/1881 | Hallidie | 57/215 |
| 1,996,689 | 4/1935 | Rohs | 57/311 |
| 2,156,652 | 5/1939 | Harris | 57/215 |
| 2,241,955 | 5/1941 | Noyer et al. | 57/215 X |
| 3,083,817 | 4/1963 | Campbell | 205/2 |
| 3,183,658 | 5/1965 | Peterson | 57/22 X |
| 3,778,993 | 12/1973 | Glushko et al. | 57/145 |
| 4,311,001 | 1/1982 | Glushko et al. | 57/215 |
| 4,454,708 | 6/1984 | Verreet | 57/215 |
| 4,530,205 | 7/1985 | Seiler et al. | 57/9 |
| 4,604,861 | 8/1986 | Matsuura et al. | 57/9 |

*Primary Examiner*—Joseph J. Hail, III
*Assistant Examiner*—William Strysewski
*Attorney, Agent, or Firm*—Hudak & Shunk Co.

[57] ABSTRACT

A stranded product is formed from a central wire and a plurality of wires helically wound around the central wire, wherein each of the wires helically wound around the central wire has a small longitudinal groove which increases the area of contact between each of the outer wires and the core wire, thus significantly reducing the internal contact stresses within the strand to extend the fatigue life of the strand without significantly reducing the bending flexibility of the strand. A plurality of stranded products in accordance with the invention can be employed in a conventional manner to form ropes, cables and the like, having an extended service life.

14 Claims, 1 Drawing Sheet

WIDE ROPE WITH REDUCED INTERNAL CONTACT STRESSES

FIELD OF THE INVENTION

The invention relates to wire ropes formed by twisting, plaiting or arranging in parallel a plurality of strands, each of which comprises a central wire and one or more wires helically wound around the central wire. More particularly, the invention relates to stranded products formed by a method of modifying and arranging the wires to reduce internal contact stresses and, consequently, increase the fatigue resistance and the useful service life of the stranded product.

BACKGROUND

Wire ropes are commonly used in a variety of mechanical applications where both strength and flexibility are simultaneously desired such as hoists, elevators, tire cords and the like. Wire rope is generally composed of a plurality (usually six to eight) of preformed strands which are helically wound about a core of hemp, polypropylene or steel wire. The core acts as an elastic support for the strands and is intended to prevent excessive contact stresses between the wires. The individual strands of a rope typically consist of a plurality of wires helically wrapped around a center wire. Until recently little attention has been directed to reducing contact stresses between the individual wires of a strand. In particular, it has only been relatively recently that investigators have begun analyzing the effects of modified strand designs which reduce internal contact stresses between individual wires of a strand.

Prior modifications of the strand geometry were primarily directed to methods wherein wires of circular cross section and/or strands consisting of a plurality of wires are plastically deformed by passing them through a die in order to produce a more solid and compact rope. U.S. Pat. Nos. 251,141; 2,156,652; 3,083,817; 3,778,993; 4,311,001; 4,454,708 and 4,530,205 all generally relate to wire ropes and methods of making wire ropes wherein the wires and/or the wound strands are subjected to compression with the aid of reducing means so as to cause plastic deformation thereof, and to improvements relating to methods which ensure uniform deformation over the cross-section of the strand and/or reduction of the voids therein. This plastic deformation, prevalent in the cited prior art, causes the stranded wires, and ropes, cables and the like made therefrom, to become comparatively stiff and resistant to bending, resulting in a composite structure with properties approaching those of a solid rod-shaped member, thus tending to defeat one of the primary objectives of stranded wire structures which is to provide high load bearing strength in a structure having high bending flexibility.

More recently, Conway, T. A. and Costello, G. A. (1991), Response of a Strand with Elliptical Outer Wires, Int. J. Solids Structures, 28(1), 33–42 disclose a theoretical comparative stress analysis between typical wire ropes having outer wires with a circular cross-section and wires having an elliptical cross-section. The analysis suggests that elliptical outer wires will reduce internal contact stresses by as much as about 25 percent compared with outer wires having a circular cross-section.

SUMMARY OF THE INVENTION

The present invention relates to a wire strand configuration wherein outer helically wound wires having a generally circular cross-section are provided with a small concave groove or a small flat area which contacts the center or core wire. The small concave groove in the outer helically wound wires preferably have a radius of curvature which is at least equal to that of the core wire in order to increase the area of contact between the outer wires and the core wire while minimizing the reduction in voids within the strand. That is to say, in accordance with the invention, the grooves are provided primarily for the purpose of increasing the contact area between the outer wires and the core wire, without significantly reducing the overall diameter of the strand. The increased area of contact between the outer helically wound wires and the core wire leads to a dramatic reduction in the magnitude of the internal contact stresses in strands made in accordance with the principles of the invention, which in turn leads to a substantial increase in the useful service life of the strands or ropes, cables and the like, made therefrom.

In accordance with the principles of the invention, a small concave groove or small flat area is formed in each of the helically wound outer wires along a linear longitudinal portion of the outer wire which is in contact with the core wire of the finished strand. Contrary to prior art methods wherein outer wires of non-circular cross-section are formed by plastic deformation, the groove or flat surface of the outer wires of the present invention are preferably formed by removing material such as by milling or cutting to form a small longitudinal groove along which the helically wound outer wires contact the core wire. The groove is relatively small so as to have a negligible effect on the overall diameter of the strand and hence a negligible effect on the bending flexibility of the strand.

In order to substantially increase the area of contact between each of the individual outer wires and the core wire, the groove should be either flat or more preferably concave with a radius of curvature which is at least as great as the radius of curvature of the core wire.

DETAILED DESCRIPTION OF THE INVENTION

The principles of the present invention are generally applicable to a variety of wire strand designs comprising a core wire and a plurality of outer wires helically wound about a core wire. The wires can generally be composed of any suitable metal such as steel. The full advantages of the invention are best realized when each of the outer wires has a substantially circular cross-section of about the same diameter, that diameter being about equal to, and preferably from about 50 percent to about 100 percent of, the diameter of the core wire. Thus, while the principles of the invention can be utilized to reduce internal contact stresses for single and multilayer strand designs employing any number of outer wires, the combined advantages of increased bending flexibility and improved fatigue life are most dramatic for wire strand configurations having from about 4 to about 8, and preferably 6 or 7, outer wires helically arranged in a single layer about the core wire.

Figure 1:
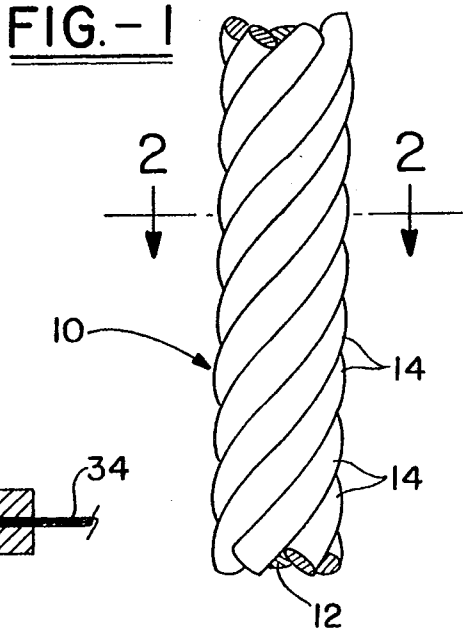
FIG. 1 is an elevational view of a strand having a core and a plurality of helically wound outer wires in accordance with the invention.
Figure 2:
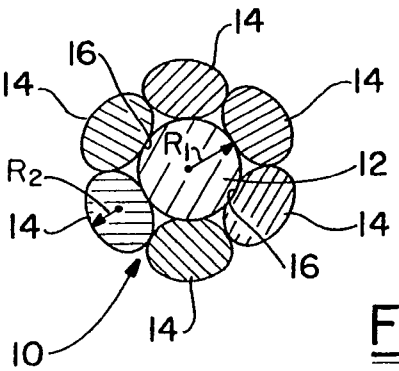
FIG. 2 is a transverse cross-section of the wire shown in FIG. 1.

For purposes of illustration, the invention will be described with reference to a strand 10, shown in FIGS. 1 and 2, employing a center or core wire 12 having a circular cross-section and a radius, $R_1$, which is slightly larger than each of six outer wires 14 having a substantially circular transverse cross-section of radius $R_2$.

Each of the outer wires has a small longitudinal groove along which it contacts the core wire. The groove is at least as deep as the transverse deflection caused by Poisson's effect, but not so deep as to significantly affect the stiffness or bending flexibility of the rope. Generally, the depth of the groove should be no greater than twice the deflection caused by the Poisson's effect in order to avoid a reduction in the voids between the wires 12 and 14 which would significantly affect bending flexibility. The actual depth of the groove, therefore, depends on a number of parameters which affect Poisson's effect, including the hardness and modulus of the material from which the wires are made. For metal wires such as steel wires, the depth of the groove is generally from about 0.01 to about 5 percent, more desirably from about 0.05 to about 2 percent, and preferably from about 0.1 percent to about 0.5 percent of the diameter of the wire 14. It will be appreciated that a groove of this magnitude amounts to what may be regarded as a longitudinal scratch in the surface of the wires 14.

To achieve the maximum reduction of internal contact stresses for a given departure of the outer wires 14 from circular geometry, the grooves 16 preferably have a radius of curvature which is just slightly larger than the radius of curvature of the core wire 12. It will be readily apparent to those skilled in the art that the area of contact between the core wire 12 and the helically wound outer wires 14 can be maximized when the radius of curvature of the groove 16 in the outer wires is slightly larger than the radius of the core wire, whereas if the radius of the groove is less than that of the core wire 12, the area of contact between the core wire and the outer wires is represented only by a pair of thin parallel lines helically wrapped around the core wire 12 with no contact of the core and outer wires in the area between the lines as would be the case if the radius of curvature of the groove is only slightly greater than that of the core wire.

Figure 4:
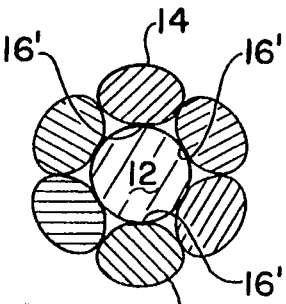
FIG. 4 is a transverse cross-section of a specific embodiment of the wire shown in FIG. 1 wherein the outer wires have flat grooves in accordance with one aspect of the invention.

Significant reductions in the internal contact stresses are achieved in accordance with the invention when the groove has a geometry ranging anywhere from a concave radius of curvature which is at least equal to the radius of curvature of the core wire up to an infinite radius of curvature, i.e. a flat surface. FIG. 4 shows outer wires having grooves 16' which are flat. Accordingly, the term longitudinal groove as used to describe the area of contact between the core wire 12 and outer wires 14 will be understood to embrace a modification to the outer wire 14 wherein the outer wire is provided with a small longitudinally extending flattened area, as well as modifications wherein a longitudinally extending concave groove is provided.

Figure 3:
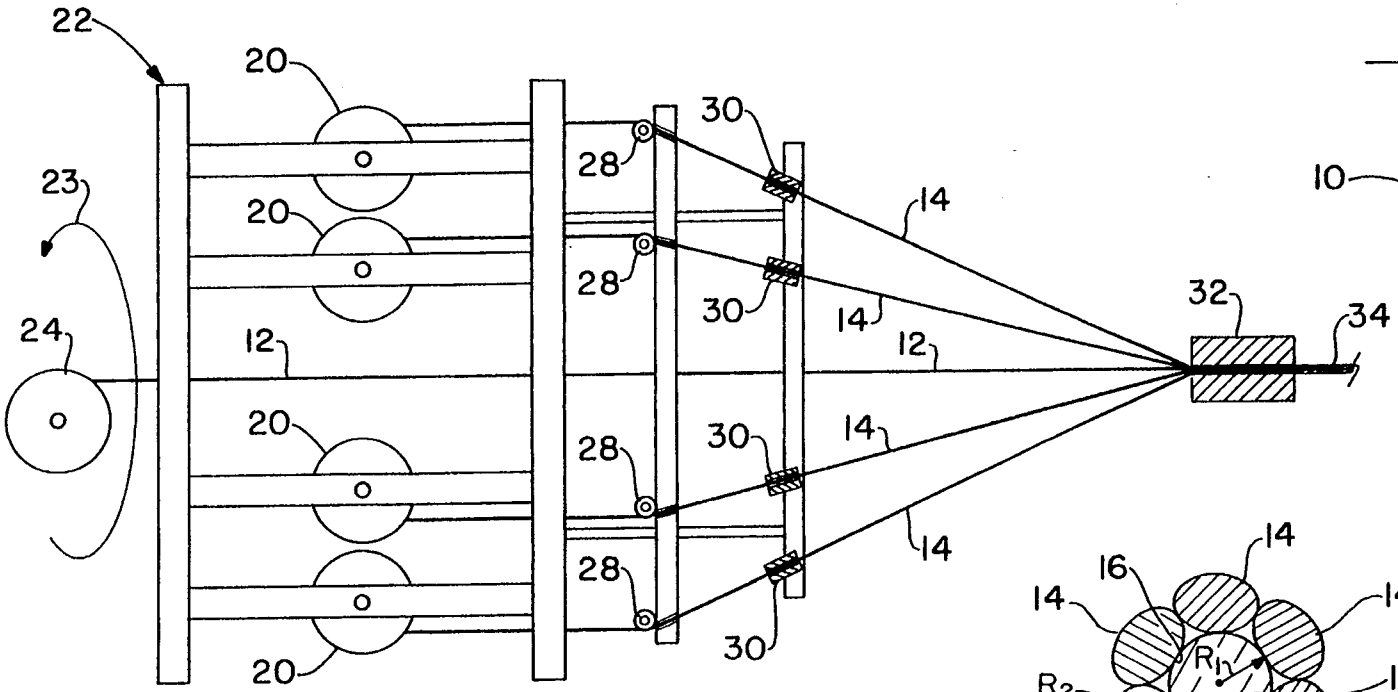
FIG. 3 is a schematic representation of an apparatus suitable for making the stranded product of the invention.

The wire strands of the invention can be made using various conventional rope making machines. A suitable apparatus, shown in FIG. 3, comprises a plurality of wire supply drums or reels 20 rotationally supported on a frame 22. The frame 22 is rotatable as indicated by arrow 23, about a central axis coincident with the core wire which has a separate supply reel 24 which is not supported on frame 22 and which is not rotated about the central axis. The outer wires 14 are guided over guide rollers 28 and through dies or milling or cutting tools 30 wherein a small longitudinal groove as described herein is provided along the area of the outer wire 14 which contracts the core wire 12. The outer wires 14 converge toward the center wire and along with the core wire pass through the stranding die 32 which causes the individual outer wires 14 to wrap helically about the core wire 12 to form the stranded product 34.

Conventional techniques and apparatus can be used to form various stranded products such as rope, cables and the like comprising a plurality of stranded products 34.

While the groove in the outer wire can be formed at tool 30 immediately prior to stranding, as previously described, it is also possible to form the groove using a separate apparatus. In this case, the outer wires 14 on reels 20 would have a preformed groove and tools 30 would be replaced with orientation dies which merely serve to properly orientate the wires prior to stranding so that the groove properly contacts the surface of the core wire 12.

The groove can be formed either by passing the outer wires through a die having the desired shape, or preferably the groove can be formed by various conventional cutting, milling or machining operations. The die or cutting tool should be made from a material having a suitable hardness greater than that of the wire. Suitable materials for the die or cutting tool include tungsten carbide and hardened steel.

The internal contact stresses for the invention are typically reduced by at least 25 percent, desirably at least 50 percent and preferably at least 75 percent as compared with outer wires having a circular transverse cross-section. Theoretical analysis suggests that the stranded products of the invention can achieve up to over an 80 percent reduction in the internal contact stresses as compared with conventional designs using outer wires having a circular transverse cross-section. This dramatic reduction in internal contact stresses is achieved with only a negligible, if any, effect on bending flexibility. With the invention, the amount of deflection on the wires caused by internal contact stresses upon loading is reduced to a level within the region of elastic deformation and the internal contact stresses which would otherwise be up to 5 times greater than the axial stress on the core is reduced to a level wherein the predominant design stress or design parameter is the axial stress.

The reduced contact stresses of the invention are expected to result in reduced fatigue and a longer useful service life for the stranded products of the invention as compared with conventional stranded products. The service life of the stranded products of the invention are expected to have a service life at least 25 percent, desirably 50 percent, and preferably more than 100 percent or more than 200 percent greater than that of a conventional stranded product having a circular core wire and outer wires having circular transverse cross-sections.

While in accordance with the Patent Statutes, the best mode and preferred embodiment has been set forth, the scope of the invention is not limited thereto, but rather by the scope of the attached claims.

What is claimed is:

1. A stranded wire product comprising a core wire and a plurality of outer wires helically wound about the core wire, each of the outer wires having a longitudinal groove, each of the outer wires contacting the core wire along the longitudinal groove, said core wire having a substantially circular transverse cross-section and each of said outer wires having a transverse cross-section which is substantially circular except for said groove.

2. A stranded wire product as set forth in claim 1, wherein each of the outer wires has substantially the same diameter, and wherein the diameter of each outer wire is from about 50 percent to about 100 percent of the diameter of the core wire.

3. A stranded wire product as set forth in claim 2, wherein the number of outer wires is from about 4 to about 8.

4. A stranded wire product as set forth in claim 3, wherein the groove is concave and has a radius of curvature equal or greater than that of the core wire.

5. A stranded wire product as set forth in claim 3, wherein the groove is flat.

6. A stranded wire product as set forth in claim 5, wherein the number of outer wires is 4 or 5.

7. A stranded wire product as set forth in claim 2, wherein the wires are of steel, and wherein the depth of the groove of each of the outer wires is from about 0.1 percent to about 0.5 percent of the diameter of the outer wire.

8. A stranded wire product comprising a metal core wire having a substantially circular transverse cross-section and a plurality of metal outer wires helical wound about the core wire, each of said outer wires having a substantially circular transverse cross-section and having a longitudinal groove, the depth of each of said grooves being less than about 5 percent of the diameter of each of said outer wires, each of said grooves having a radius of curvature which is at least equal to that of the core wire, said outer wires being arranged such that contact between each of said outer wires and said core wire is substantially confined to the grooves.

9. A stranded wire product as set forth in claim 8, wherein the longitudinal groove of each of said outer wires is formed by a milling operation to avoid plastic deformation of the outer wire.

10. A stranded wire product as set forth in claim 9, wherein each of the outer wires has substantially the same diameter, and wherein the diameter of each outer wire is from about 50 percent to about 100 percent of the diameter of the core wire.

11. A stranded wire product as set forth in claim 10, wherein the number of outer wires is from about 4 to about 8.

12. A stranded wire product as set forth in claim 11, wherein the wires are of steel, and wherein the depth of the groove of each of the outer wires is from about 0.1 percent to about 0.5 percent of the diameter of the outer wire.

13. A stranded wire product as set forth in claim 8, wherein the number of outer wires is 6 or 7.

14. A rope comprising a plurality of twisted stranded products, each of said twisted stranded products comprising a core wire and a plurality of outer wires helically wound about the core wire, each of the outer wires having a longitudinal groove, each of the outer wires contacting the core along the longitudinal groove, said core wire having a substantially circular transverse cross-section and each of said outer wires having a substantially circular transverse cross-section except for said groove.

* * * * *

UNITED STATES PATENT AND TRADEMARK OFFICE

CERTIFICATE OF CORRECTION

PATENT NO. : 5,375,404

DATED : December 27, 1994

INVENTOR(S) : Ted A. Conway

It is certified that error appears in the above–identified patent and that said Letters Patent is hereby corrected as shown below:

On title page, item [54] and col. 1, line 1,
In the title, please delete the word "WIDE" and substitute therefor -- WIRE --.

Signed and Sealed this

Twenty-fourth Day of February, 1998

*Attest:*

Bruce Lehman

BRUCE LEHMAN

*Attesting Officer*

*Commissioner of Patents and Trademarks*